US005244344A

United States Patent [19]

Doeberl et al.

[11] Patent Number: 5,244,344

[45] Date of Patent: Sep. 14, 1993

[54] CODE BREAK MECHANISM FOR STACKING APPARATUS

[75] Inventors: Terrence M. Doeberl, West Redding; Ralph K. Rand, Sandy Hook, both of Conn.; Larry S. Payne, Farmers Branch, Tex.; Kazutoshi Fujimoto, Arlington, Tex.; William C. Monday, Rowlett, Tex.

[73] Assignee: Pitney Bowes Inc., Stamford, Conn.

[21] Appl. No.: 607,782

[22] Filed: Oct. 31, 1990

Related U.S. Application Data

[63] Continuation of Ser. No. 291,484, Dec. 28, 1988, abandoned.

[51] Int. Cl.[5] ..... B65H 33/02

[52] U.S. Cl. ..... 414/798.2; 271/215

[58] Field of Search ..... 271/2, 179, 181, 189, 271/212, 215, 249, 253; 414/798.2, 798.5

[56] References Cited

U.S. PATENT DOCUMENTS

| | | | |
|---|---|---|---|
| 1,592,230 | 7/1926 | Sheldon | 271/181 |
| 2,843,378 | 7/1958 | Faeber | 271/87 |
| 3,520,404 | 7/1970 | Pine | 209/72 |
| 3,691,915 | 9/1972 | Kiela et al. | 271/181 X |
| 3,998,329 | 12/1976 | Araya et al. | 209/74 M |
| 4,428,573 | 1/1984 | Denison, III et al. | 271/185 X |
| 4,474,365 | 10/1984 | DiBlasio | 271/215 X |

FOREIGN PATENT DOCUMENTS

| | | | |
|---|---|---|---|
| 426209 | 3/1926 | Fed. Rep. of Germany . | |
| 1254950 | 11/1967 | Fed. Rep. of Germany | 414/798.5 |

*Primary Examiner*—Michael S. Huppert
*Assistant Examiner*—Janice Krizek
*Attorney, Agent, or Firm*—Charles G. Parks, Jr.; Melvin J. Scolnick

[57] ABSTRACT

A code break mechanism preferably employed in a stacker apparatus. The stacker apparatus has a support housing, a deck fixably mounted to and supported by the housing, a registration wall fixably mounted to the housing and extending generally perpendicular to the deck. A deflector plate is pivotally mounted in an opening in the registration wall. A rotary solenoid in communication with a linkage train causes the deflector plate to be selectively positionable from a first position coplanar with the registration wall to a second position pivotally displaced from the registration wall.

4 Claims, 5 Drawing Sheets

CODE BREAK MECHANISM FOR STACKING APPARATUS

This application is a continuation of application Ser. No. 291,484, filed Dec. 28, 1988, abandoned.

BACKGROUND OF THE INVENTION

This invention relates to a code break mechanism for a stacking apparatus receiving a stream of articles, more particularly to a code break mechanism for producing discontinuities in the stacker article stream in accordance with a selected parameter changes in the article stream.

In article processing systems, generally the last process step is the collection of processed articles. For example, in a conventional mail processing system, a power stacker may be employed to collect envelopes ejected from a mailing machine. Generally, the power stacker receives the envelopes in a seriatim and uniform manner and stacks the envelopes. An operator periodically removes the accumulated envelope stack from the stacker for packaging in preparation for subsequent deposit with a mail forwarding agent, such as, the United States Postal Service (USPS).

Mail forwarding agents, such as, the USPS, offer to the mailers special postage discount rates for mail which is presorted, for example, by zip code. Therefore, where the mail is processed in a presorted manner, for example, according to zip code, it would be advantageous to the operator for the power stacker to include a means for visually marking zip code changes or breaks within the stacker received mail stream.

SUMMARY OF THE PRESENT INVENTION

It is an object of the present invention to present a code break mechanism particularly suited for employment in a power stacker.

A particularly suited power stacker includes a deck fixably mounted to and supported by a housing such that the deck is positioned at a 15° rearward reclined angle. A registration wall is fixably mounted to the housing and extends generally perpendicular relative to the deck. A stack wall is slidably mounted to the housing at one end.

The zip code break mechanism is comprised of a deflector plate pivotally mounted within a mating opening in the registration wall. The deflector plate in a first or normal position is located coplanar with the registration surface of the registration wall. A solenoid, responding to a control signal from a controller, is fixably mounted in the housing and communicates with the deflector plate through a linkage such that actuation of the solenoid causes pivotal displacement of the deflector plate from the first position to the second position. When the deflector plate is positioned in the second position, it can laterally deflect the zip break envelope. The zip break envelope is thereby laterally misaligned with respect to the envelope stack allowing an operator to visually observe stack zip code breaks.

DETAILED DESCRIPTION OF THE PREFERRED EMBODIMENT

Figure 1:
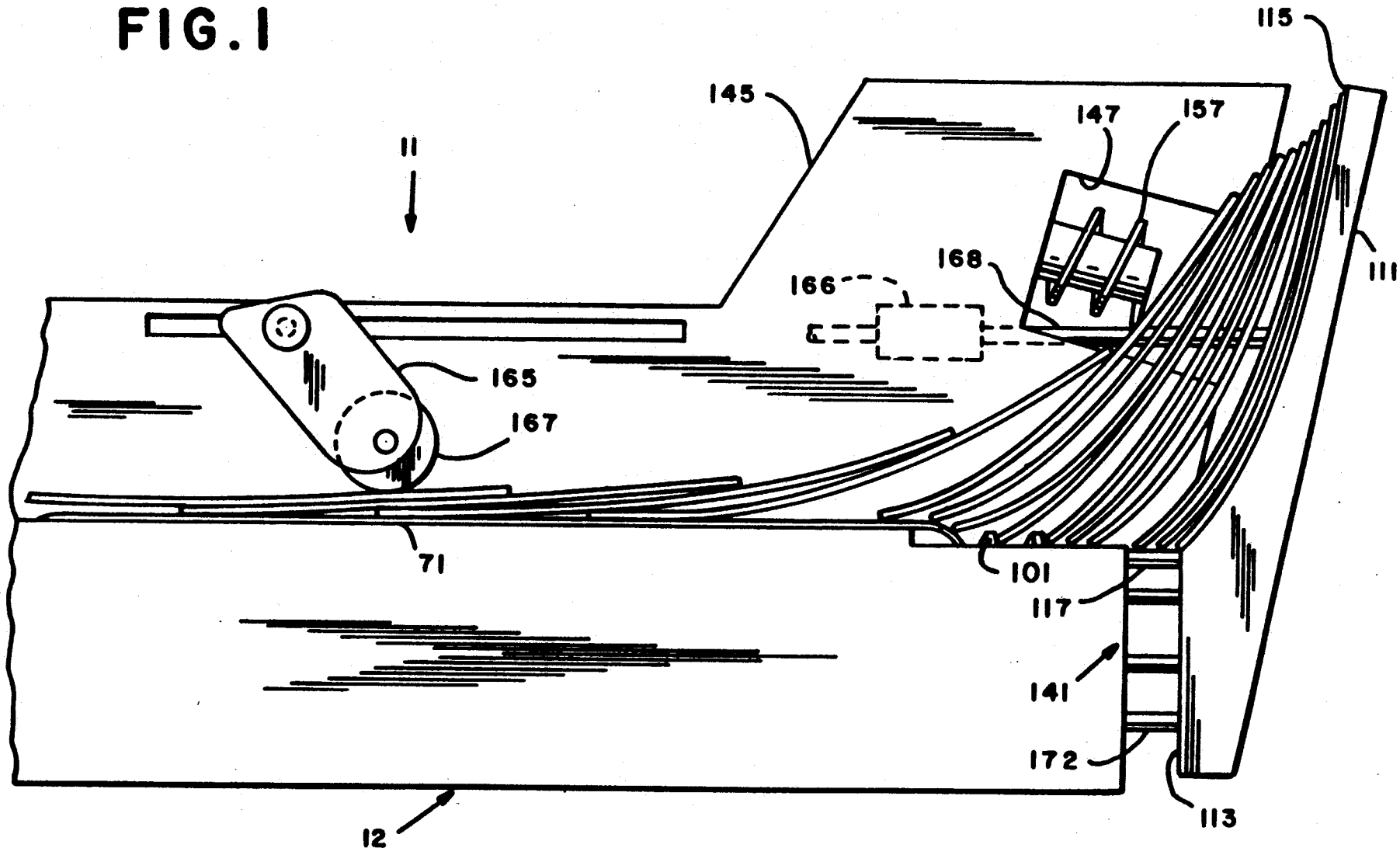
FIG. 1 is a partial side view of a power stacker in accordance with the present invention.
Figure 2:
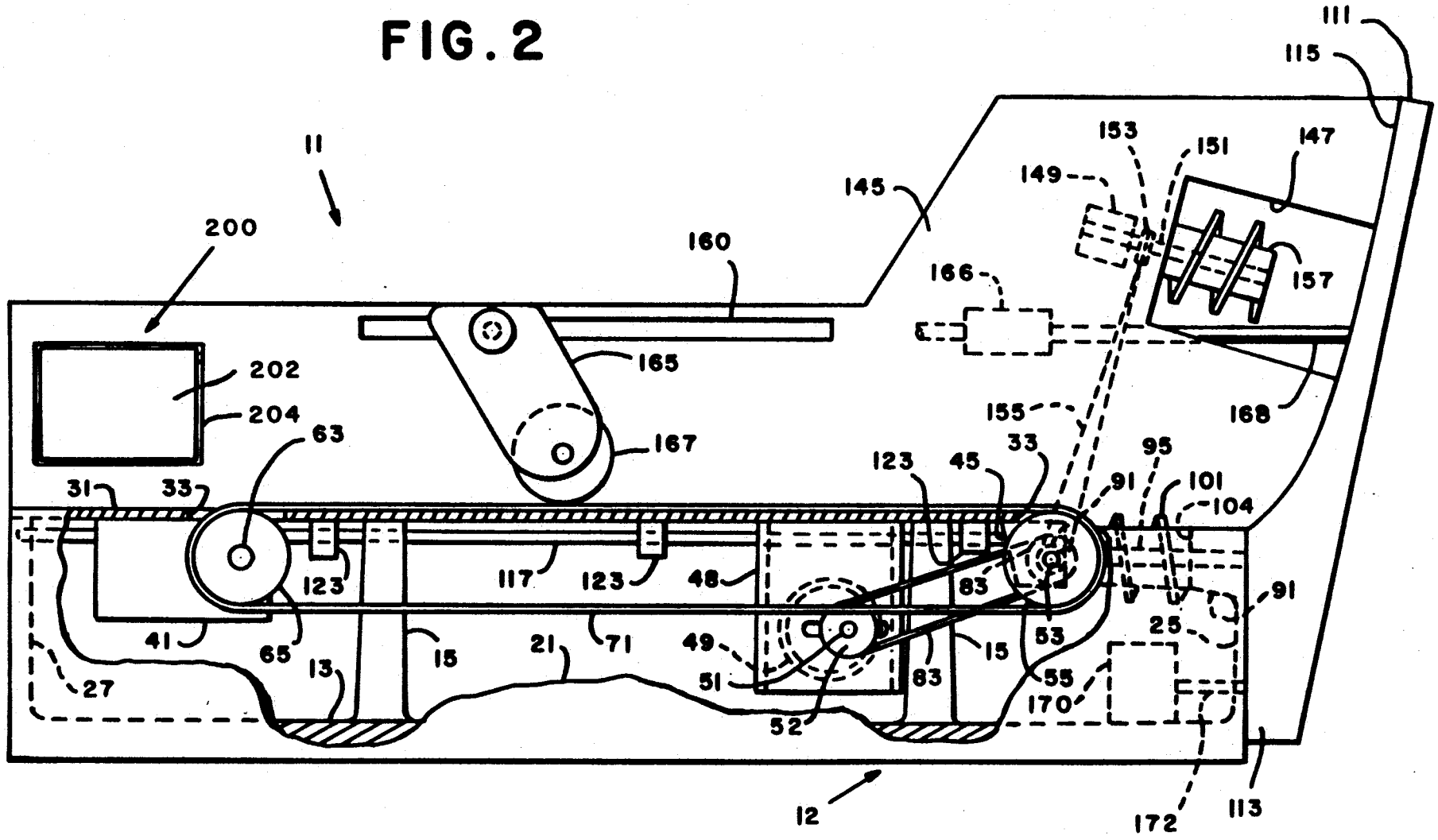
FIG. 2 is a sectioned side view of the power stacker.

Referring to FIGS. 1 and 2, a particularly suited power stacker, generally indicated at 11, is comprised of a base housing 12 having a base 13. A plurality of vertically extending support posts 15 and 17 (ref. to FIG. 3) are fixably mounted to base 13 at one end. The base 13 also has fixably mounted thereto in vertical alignment, a forward wall 21 and rear wall 23 in transversely spaced apart parallel alignment. End walls 25 and 27 are fixably mounted to the base 13 in spaced apart relationship and at their ends to respective walls 21 and 23, and base 13.

Figure 3:
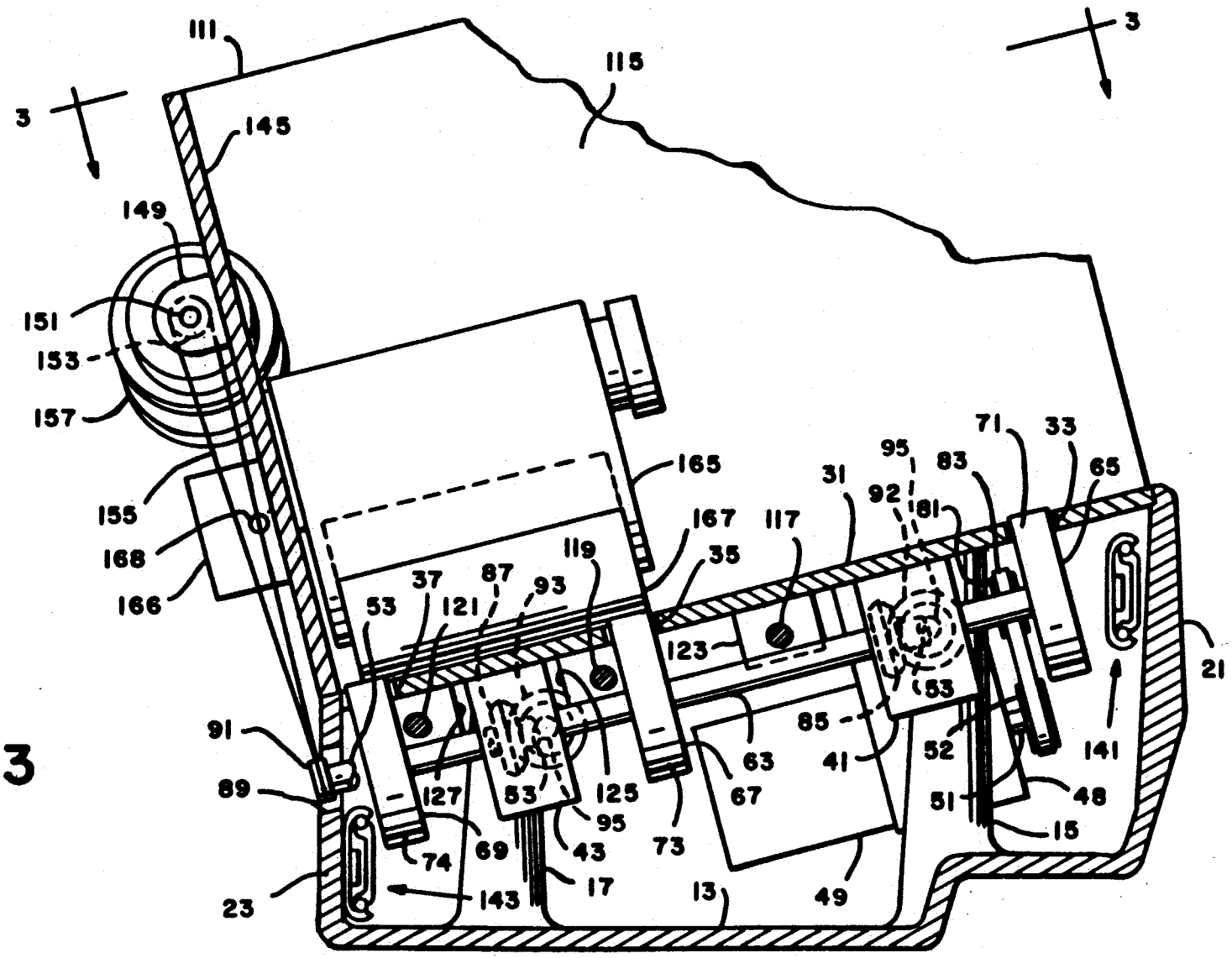
FIG. 3 is an sectioned end view of the power stacker in accordance with the present invention.

Referring also to FIG. 3, a deck 31 is fixably mounted to walls 21, 23, 25 and 27 and along its underside to the support posts 15 and 17, such that the deck assumes a reclined position, front to rear, of approximately 15° (fifteen degrees) from the horizontal. The deck 31 contains a plurality of slots 33, 35, and 37. Fixably mounted to the underside of the deck 31 at the receiving or forward end are first and second adjustable tension brace assemblies 41 and 43. Also fixably mounted to the underside of the deck 31 at the other end are braces 45. The braces 45 are longitudinally aligned with a respective tension brace assembly 41 or 43.

A motor mount 48, having a motor 49 mounted thereto, is fixably mounted to the underside of the deck 31. The motor 49 includes an output shaft 51 having a pulley gear 52 fixably mounted around the output shaft 51. A shaft 53 carries a plurality of fixably mounted friction wheels 55, in spaced apart relationship. The friction wheels 55 are radially aligned with the respective first slots 33, 35 and 37. A second shaft 63 is rotatively mounted in the tension brace assemblies 41 and 42. The shaft 63 carries a plurality of friction wheels 65 radially aligned with the respective second slots 33, 35 and 37. A plurality of endless belts 71, 73, and 74 extend around the respective friction wheel pairs 55 and 65.

The shaft 53 further includes a pulley gear 81 which is in endless belt 83 communication with the motor 49 for providing driving force to shaft 53. The shaft 53 further includes bevel gears 85 and 87 fixably mounted therearound in axially spaced apart relationship. The rear wall 23 includes an aperture 89 through which an end portion of the shaft 53 extends and has fixably mounted therealong a pulley 91.

End wall 25 has formed thereon a plurality of studs 91 through which extends a respective short shaft 95 seated at one end in the end wall 25. Rotatively mounted around a portion of respective shafts 95 is a respective threaded hub 101. Each of the threaded hubs 101 are mounted such that the threaded hubs 101 partially extends into a respective recess 104 formed into the deck 31. A bevel gear 92 and 93 are rotatively mounted around a respective shafts 95 in driving communication with the respective threaded hubs 101. The bevel gears 92 and 93 are in constant mesh with respective bevel gears 85 and 87.

A stack wall 111 has a formed facing surface 113 abutting to the outer face of end wall 25 leading to a vertically reclined surface 115. A plurality of guide rods 117, 119, and 121 are fixably mounted at one end to the facing surface of the stack wall 111. The guide rods 117, 119, and 121 extend slidably through respective apertures in the end wall and are slidably received by a plurality of respective guide tabs 123, 125, and 127. The guide tabs 123, 125, and 127 are fixably mounted to the underside of the deck 31. Referring to FIG. 3, there is seen slide rail assemblies 141 and 143 having a rail portion fixably mounted to the respective side walls 21 and 23. Another rail portion of rail assemblies 141 and 143 is fixably mounted at one end to the facing surface 113 of the stack wall 111 such that the stack wall 111 can be slidably displaced.

Referring more particularly to FIGS. 2 and 3, a registration wall 145 is fixably mounted longitudinally along the rear wall 23 and orientated generally perpendicular to the deck 31. The registration wall 145 includes a recess 147 angled generally perpendicular to the reclined surface 115 of stack wall 111. A brace 149 is fixably mounted to the back surface of the registration wall 145. The brace 149 includes a shaft 151 rotatively mounted therein such that the shaft 151 extends generally perpendicular to the recline surface 115 of the stack wall 111. A pulley 153 is fixably mounted to the shaft 151. The pulley 153 is in communication with the pulley 91 mounted to shaft 63 through a belt 155. A threaded hub 157 is fixably mounted around the shaft 151.

The registration wall 145 further includes a slot 160. A yoke 165 is pivotally and longitudinally adjustably mounted in slot 160 of the registration wall 145 such that the yoke 165 can be adjustably mounted to a desired position along slot 160. The yoke 165 carries a yoke wheel 167 rotatively mounted between the forks of the yoke 165. The yoke 165 is adjustably mounted in slot 160 such that the yoke wheel rests on the deck 31. Also fixably mounted to the back of the registration wall 145 is a guide rod 168 which extends slidably through a slide member 166 fixably mounted to the registration wall 145. The guide rod 168 is pivotally mounted at one end to the stack wall 111.

Figure 4:
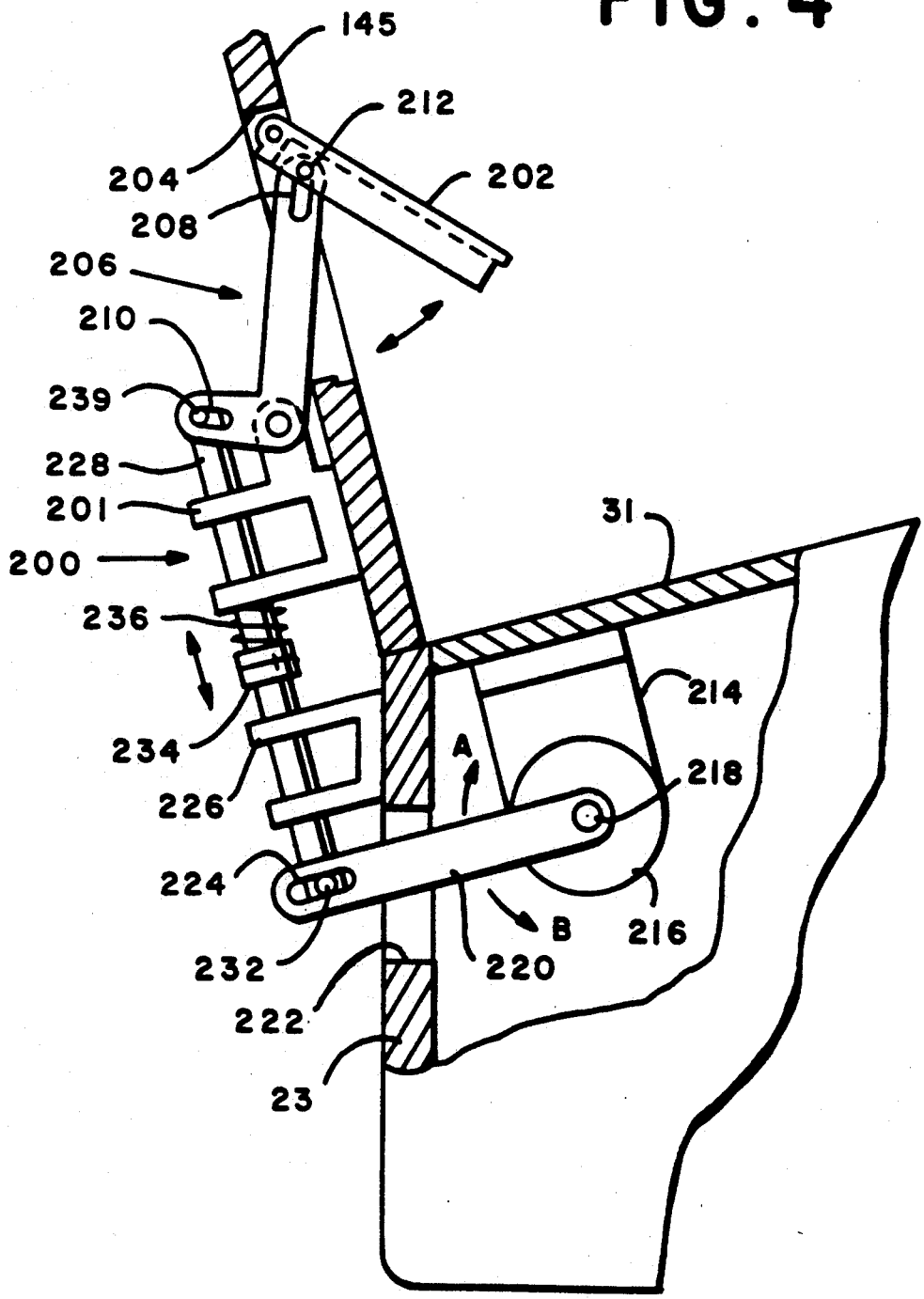
FIG. 4 is a end view of a code break mechanism in accordance with the present invention.

Referring to FIG. 4, the code break mechanism, generally indicated as 200, includes a deflector plate 202 pivotally mounted in a mating opening 204 in the registration wall 145. A bracket 201 is fixably mounted to the back face of the registration wall 145. Pivotally mounted to the bracket 201 is a generally L-shaped link 206 having a first slot 208 and a second slot 210. A pin 212 is formed to the back face of the deflector plate 202 such that the pin 212 is captured in the slot 208 of the link 206.

A bracket 214 is fixably mounted to the underside of the deck 31 and fixably supports a rotary solenoid 216. The output shaft 218 of the rotary solenoid 216 has fixably mounted thereto one end of a link 220. The link 220 extends through an aperture 222 in the rear wall 23 and has a slot 224 formed in its other end. A second bracket 226 is fixably mounted to the rear wall 23. Slidably mounted through the brackets 201 and 226 is a link 228 having a hub 230 formed at one end slidably captured in slot 210 of link 206 and at the other end of link 228 a formed pin 232 is slidably captured in slot 224 of link 220. The link 228 includes a coupling 234. A spring 236 is coiled around the link 228 between the coupling 234 and the bracket 201.

Figure 5:
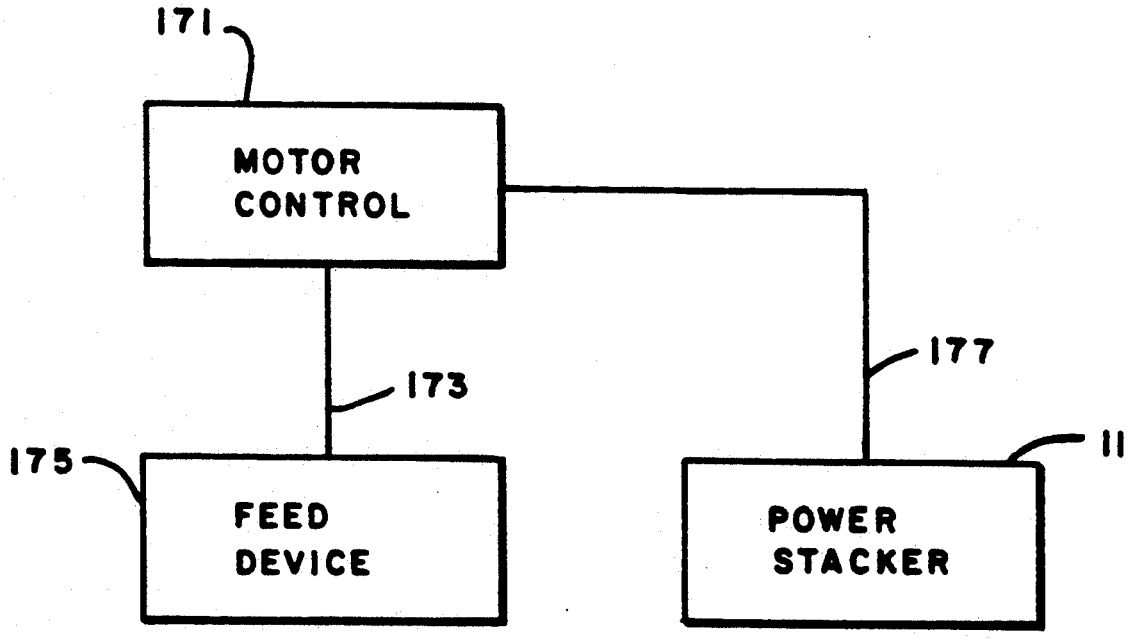
FIG. 5 is a schematic of a motor control for said power stacker.

Referring further to FIG. 5, in operation, a suitable motor controller 171 is in electrical communication through line 173 with an envelope feed device 175, for example, a mailing machine, and through line 177 with the motor 49 and rotary solenoid 216 of the power stacker 11. The motor controller 171 synchronously controls the operating speed of the power stacker 11, rotary solenoid 216 and the feed device 175 such that envelopes, for example, 5 inch envelope delivered by the feed device are received by the power stacker in a shingled fashion with approximately a 0.75 inch spacing between the leading edge of successive envelopes. The envelopes are transported by the belts 71, 73 and 75 which are under the drive influence of motor 49 through belt 83 and shaft 53, under the yoke roller 167 such that the leading edge of the lead envelopes engages the stack wall facing 115 and are caused to assume a generally vertical position against the stack wall. The subsequent envelopes are caused to assume a generally parallel orientation relative to the lead envelope. The positioning of envelopes is assisted by the edge engagement of the envelopes with the threaded hubs 101.

Upon activation by the motor controller 171 occasioned by the presence of a code break letter being discharged from the feed device 175, the rotary solenoid 216 rotatively displaces link 220 in the direction of arrow A. The displacement of link 220 is transmitted by link 228 to cause link 206 to pivotally displace. The displacement of link 206 causes the deflector plate 202 to pivotally displace from a first position coplanar with the registration wall 145 to a second position whereupon the deflector plate 202 encounters the code break envelope in route. The code break envelope is consequentially displaced laterally relative to the other stacker received envelopes.

As the envelopes are caused to vertically stack, edge engagement of the envelopes with the threaded hubs 101, 103 and 157 cause the stack wall to displace outwardly. The rods 117, 119, 121 and 168 support the stacked envelopes as the stack wall is displaced. During vertical stacking of the envelopes, the code break envelope remains perceptively displaced laterally.

The afore description is of the preferred embodiment of the present invention and should not be viewed as limiting to the invention. The scope of the invention is defined by the appendix claims.

What is claimed is:

1. A combination for collecting delivered articles, comprising:

a power stacker having a support housing, a deck fixably mounted to and supported by said housing, a registration wall fixably mounted to said housing and extending generally perpendicular to said deck, a stack wall slidably mounted to said housing at one end of said deck and having a reclined surface extending generally upwardly from said deck, said stack wall being slidably mounted to said housing such that said stack wall can be horizontally displaced outwardly from said deck, means for causing said delivered articles to be forcibly stacked against said stack wall, support means slidably mounted to said housing for providing article support between said deck and said displaced stack wall and biasing means for providing a counter return force to said stack wall;

a code break mechanism having a deflector means for encountering a select one of said articles and causing said selected article to be stacked by said power stacker such that said selected article presents a visual discontinuity relative to other said articles stacked by said power stacker;

said deflector means having a deflector plate pivotally mounted in an opening in said registration wall, and drive means for causing said deflector plate to be selectively positionable from a first position coplanar with said registration wall to a second position pivotally displaced from said registration wall;

said drive means having a rotary output shaft, a first link fixably mounted at one end to said output shaft, and linking means for connecting said other end of said first link with said deflector plate such that pivotal displacement of said first link causes said deflector plate to move to said first or second position.

2. A combination for collecting delivered articles comprising:

a power stacker having a support housing, a deck fixably mounted to and supported by said housing, a registration wall fixably mounted to said housing and extending generally perpendicular to said deck, a stack wall slidably mounted to said housing at one end of said deck and having a reclined surface extending generally upwardly from said deck, said stack wall being slidably mounted to said housing such that said stack wall can be horizontally displaced outwardly from said deck, means for causing said delivered articles to be forcibly stacked against said stack wall, support means slidably mounted to said housing for providing article support between said deck and said displaced stack wall and biasing means for providing a counter return force to said stack wall;

a code break mechanism having a deflector means for encountering a select one of said articles and causing said selected article to be stacked by said power stacker such that said selected article presents a visual discontinuity relative to other of said articles stacked by said power stacker; and, said deflector means having a deflector plate pivotally mounted in an opening in said registration wall, and drive means for causing said deflector plate to be selectively positionable from a first position coplanar with said registration wall to a second position pivotally displaced from said registration wall, said drive means having a rotary solenoid having a rotary output shaft fixably mounted to the underside of said deck, a first link fixably mounted at one end to said output shaft and linking means for connecting said other end of said first link with said deflector plate such that pivotal displacement of said first link causes said deflector plate to move to said first or second position.

3. A combination as claimed in claim 2, wherein said deflector means further comprises biasing means for biasing said deflector plate in said first position acting on said linking means.

4. A combination as claimed in claims 1, 2 or 3, further comprising control means for selectively activating said code break mechanism.

* * * * *